US009738417B2

(12) United States Patent
Ness

(10) Patent No.: US 9,738,417 B2
(45) Date of Patent: Aug. 22, 2017

(54) TANK APPARATUS

(71) Applicant: Danny Ness, Metairie, LA (US)

(72) Inventor: Danny Ness, Metairie, LA (US)

( * ) Notice: Subject to any disclaimer, the term of this patent is extended or adjusted under 35 U.S.C. 154(b) by 0 days.

(21) Appl. No.: 13/905,752

(22) Filed: May 30, 2013

(65) Prior Publication Data

US 2014/0021209 A1 Jan. 23, 2014

Related U.S. Application Data

(60) Provisional application No. 61/654,443, filed on Jun. 1, 2012.

(51) Int. Cl.

| | |
|---|---|
| ***B65D 25/00*** | (2006.01) |
| ***B65D 90/48*** | (2006.01) |
| ***B65D 88/12*** | (2006.01) |

(52) U.S. Cl.

CPC ..... *B65D 25/00* (2013.01); *B65D 88/128* (2013.01); *B65D 90/48* (2013.01); *B65D 2588/125* (2013.01)

(58) Field of Classification Search

CPC ..... B65D 90/48; B65D 25/00; B65D 88/00; B65D 88/128; B65D 2588/125; B65D 25/56; B65D 25/54; G01F 23/02

See application file for complete search history.

(56) References Cited

U.S. PATENT DOCUMENTS

| | | | | |
|---|---|---|---|---|
| 1,039,060 | A * | 9/1912 | Hughes | 220/663 |
| 1,929,709 | A | 10/1933 | Neely | |
| 1,978,608 | A | 10/1934 | Straty | |
| 2,136,474 | A | 11/1938 | Straty | |
| 3,406,855 | A | 10/1968 | McKechnie | |
| 3,687,087 | A | 8/1972 | Yurkoski et al. | |
| 4,557,406 | A | 12/1985 | Olinger et al. | |
| 4,782,973 | A | 11/1988 | Wiese | |

(Continued)

FOREIGN PATENT DOCUMENTS

| | | |
|---|---|---|
| CN | 201712987 U | 1/2011 |
| DE | 1220784 B | 7/1966 |

(Continued)

OTHER PUBLICATIONS

Written Opinion of the International Searching Authority for International Application No. PCT/US2013/043349, Oct. 2, 2013.

*Primary Examiner* — Jeffrey Allen

(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A tank rack apparatus provides a liquid storage tank. The tank includes a tank vessel having a top wall, bottom wall, side walls, and tank corners at the interface of each pair of adjacent side wall, each side wall defining a wall plane. A tank alcove provides a recess that is spaced away from a tank corner and inwardly from a tank wall plane. This inwardly spaced recess provides an alcove space having an alcove wall, an alcove top, and an alcove bottom. A sight glass gage is contained within the alcove space, below the alcove top and above the alcove bottom and inwardly of the tank wall plane. A screen occupies a position in or near the wall plane, the screen extending between a position next to alcove top and a position next to the alcove bottom.

18 Claims, 3 Drawing Sheets

(56) References Cited

U.S. PATENT DOCUMENTS

| | | | | | |
|---|---|---|---|---|---|
| 5,197,627 | A * | 3/1993 | Disabato | B65D 90/24 220/23.83 |
| 5,287,717 | A | 2/1994 | Lancaster | |
| 5,323,653 | A * | 6/1994 | Gruett | 73/326 |
| 5,474,205 | A | 12/1995 | Lancaster | |
| 5,505,070 | A | 4/1996 | Rude et al. | |
| 5,566,848 | A | 10/1996 | Rude et al. | |
| 5,701,776 | A | 12/1997 | Cowan et al. | |
| 5,718,351 | A | 2/1998 | Rude | |
| 5,833,391 | A * | 11/1998 | Daigle | 405/52 |
| 6,915,815 | B1 | 7/2005 | Ness | |
| 6,983,704 | B1 | 1/2006 | Ness | |
| 7,275,651 | B2 * | 10/2007 | Morales et al. | 220/203.23 |
| 7,520,707 | B1 | 4/2009 | Ness | |
| 7,552,687 | B1 | 6/2009 | Ness | |
| 7,997,214 | B1 | 8/2011 | Ness | |
| 8,079,791 | B2 | 12/2011 | Ness | |
| 8,104,501 | B1 | 1/2012 | Ness | |
| 2007/0056975 | A1 * | 3/2007 | Long et al. | 220/565 |

FOREIGN PATENT DOCUMENTS

| | | | |
|---|---|---|---|
| FR | 1538651 | A | 9/1968 |
| JP | 3157953 | U | 3/2010 |
| JP | 3159304 | U | 5/2010 |
| WO | 2011106698 | A1 | 9/2011 |

* cited by examiner

TANK APPARATUS

CROSS-REFERENCE TO RELATED APPLICATIONS

This is a non provisional patent application of U.S. Provisional Patent Application Ser. No. 61/654,443, filed 1 Jun. 2012.

Priority of U.S. Provisional Patent Application Ser. No. 61/654,443, filed 1 Jun. 2012, hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to portable storage racks that can transport multiple tanks. More particularly, the present invention relates to an improved tank that is transportable upon a rack and wherein the tank has a structurally robust construction that resists damage and including a specially configured alcove and sight glass arrangement and including protected piping.

2. General Background of the Invention

Exploration for oil and gas in an offshore environment requires transportation of liquid material to and from an offshore platform. Various liquids are used in the exploration process. Patents have issued that relate to racks that have been used to transport multiple modules such as tanks to the offshore oil and gas well drilling production platforms. Examples include the Ness U.S. Pat. Nos. 6,915,815; 6,983,704; 7,520,707; 7,552,687; 7,997,214; 8,079,791; and 8,104,501.

Other patents have issued for tank constructions. These include for example, the patents contained in the following table.

The following patents and publications are incorporated herein by reference:

TABLE

| Pat. No. | Title | Issue/Pub. Date MM-DD-YYYY |
|---|---|---|
| 1,929,709 | Liquid Storage Tank | 10-10-1933 |
| FR 1,538,651 | Deformable container | 07-28-1967 |
| 3,406,855 | Containers for the Transportation of Liquid in Bulk | 10-22-1968 |
| 4,557,406 | Storage and Shipping Bin | 12-10-1985 |
| 4,782,973 | Cushion Bottom Tank | 11-08-1988 |
| 5,287,717 | Method for Forming A Tank Bottom | 02-22-1994 |
| 5,474,205 | Tank Bottom and Tank Top | 12-12-1995 |
| 5,505,070 | Method for Forming a Sloped Bottom Tank | 04-09-1996 |
| 5,566,848 | Sloped Bottom Tank | 10-22-1996 |
| 5,701,776 | Sloped Bottom Tank | 12-30-1997 |
| 5,718,351 | Flat Bottom Tank | 02-17-1998 |

BRIEF SUMMARY OF THE INVENTION

The present invention provides a liquid storage tank apparatus. The present invention also provides a transport apparatus that includes a rack that is configured to carry multiple liquid storage tanks at the same time.

The liquid storage tank apparatus provides a tank vessel having a top wall, bottom wall, side walls and tank corners at the interface of each pair of adjacent side walls. Each side wall is preferably generally flat, defining a wall plane.

One of the tank walls has a tank alcove that provide a recess that is spaced from a tank corner, but offset from a side wall center. The alcove is thus closer to one corner than it is to another tank corner.

The alcove provides a recessed portion of the tank wall that extends inwardly of the tank wall plane.

The alcove includes an alcove wall, an alcove top and alcove bottom.

The sight glass gage is contained within and mounted within the alcove space. The sight glass gage is contained below the alcove top and above the alcove bottom and inwardly of the tank wall plane.

A protective screen can be provided that occupies a position in or next to the wall plane. The screen extends between the alcove top and alcove bottom, thus protecting the sight glass gage while enabling a user to view the gage.

The present invention thus provides a liquid storage tank that includes a tank vessel having a top wall, bottom wall, side walls, and tank corners at the interface of each pair of adjacent side walls, each side wall defining a wall plane.

A tank alcove provides a recess that is spaced from a tank corner. The alcove provides a recess portion of a tank wall that extends inwardly of the tank wall plane to provide an alcove space.

The alcove includes an alcove wall, an alcove top and an alcove bottom.

A sight glass gage is contained within the alcove space, below the alcove top, above the alcove bottom and inwardly of said tank wall plane.

An optional screen that occupies a said wall plane, the screen extending between a position next to the alcove top and a position next to the alcove bottom.

In one embodiment, the sight glass gage has an upper valve near the alcove top.

In one embodiment, the sight glass gage has a lower valve near the alcove bottom.

In one embodiment, the alcove is spaced below the top wall.

In one embodiment, the alcove is spaced above the bottom wall.

In one embodiment, the upper valve is below an upper welded connection that joins the top wall to a side wall.

In one embodiment, the lower valve is above a lower welded connection that joins the bottom wall to a side wall.

In one embodiment, lifting eyes are provided that attach to the tank body above the alcove.

In one embodiment, a vertical weldment connects each tank corner to a tank side wall.

In one embodiment, a vertical weldment connects each tank corner to the alcove panel.

In one embodiment, the alcove is spaced away from each vertical weldment.

In one embodiment, the screen is spaced below the upper valve.

In one embodiment, the screen is spaced above the lower valve.

In one embodiment, the upper valve is below an upper welded connection that joins the top wall to a side wall.

In one embodiment, the lower valve is above a lower welded connection that joins the bottom wall to a side wall.

The present invention includes a liquid storage tank comprising a tank vessel having a top wall, bottom wall, a plurality of tank side walls, and tank corners at the interface of each pair of adjacent side walls, each tank side wall defining a wall plane. One of the tank side walls has multiple panels including a larger panel and an alcove panel that includes multiple bends. The alcove panel can be a part of a tank alcove, the alcove can provide a recess that is in between the larger panel and a tank corner. The alcove panel can provide a recess portion of a tank wall that extends inwardly of a tank side wall plane to provide an alcove space. The alcove includes the alcove panel, an alcove top wall, and an alcove bottom wall. A sight glass gage can be contained within the alcove space below the alcove top and above the alcove bottom and inwardly of a tank side wall plane.

In one embodiment, the sight glass gage has a valve.

In one embodiment, the third panel has four bends.

In one embodiment, the valve is next to and below an upper welded connection that joins the top wall to a side wall.

In one embodiment, the valve is next to and above a lower welded connection that joins the bottom wall to a side wall.

In one embodiment, a screen at least partially covers the sight glass.

In one embodiment, one of the valves is an upper valve and the screen is spaced below upper valve.

In one embodiment, one of the valves is a lower valve and the screen is spaced above the lower valve.

The present invention includes liquid storage tank comprising a tank vessel having a top wall, bottom wall, a plurality of side walls, and tank corners at the interface of each pair of adjacent side walls, each side wall defining a wall plane. One of the tank side walls has a vertical centerline, multiple panels including a first larger panel and a second panel includes multiple bends. The second panel can be a part of a tank alcove that provides a recess that is in between the larger panel and a tank corner, the alcove being offset from the vertical centerline. The alcove can provide a recess portion of a tank wall that extends inwardly of a tank side wall plane to provide an alcove space. The alcove includes the second panel, an alcove top, and an alcove bottom. A sight glass gage contained within the alcove space, below the alcove top, above the alcove bottom and inwardly of a tank wall plane.

In one embodiment, a vertical weldment connects a tank corner to the second, smaller panel.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
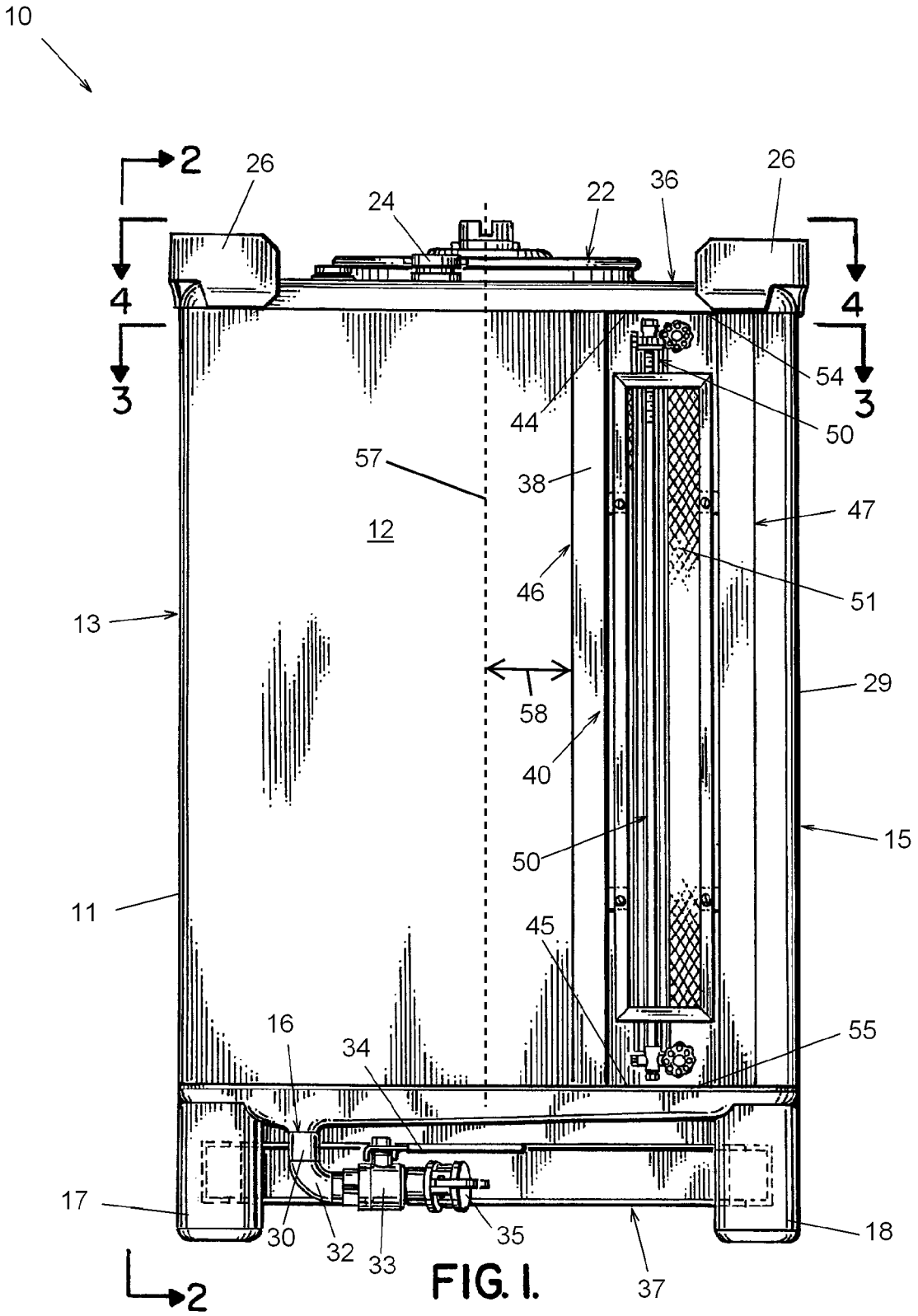
FIG. 1 is a front, elevation view of a preferred embodiment of the apparatus of the present invention.

FIGS. 1-4 show a preferred embodiment of the apparatus of the present invention designated generally by the numeral 10 in FIG. 1. Tank rack apparatus 10 provides a rack (not shown) which can be any one of the racks shown and described in U.S. Pat. Nos. 6,915,815; 6,983,704; 7,520,707; 7,552,687; 7,997,214; 8,079,791; and 8,104,501, which are each hereby incorporated herein by reference. Tank or vessel 11 provides preferably four side walls or side panels 12, 13, 14, 15. Side walls or side panels 12, 13, 14, 15 can be for example about 48 inches (122 cm) wide and about 60 inches (152 cm) long. The wall 12 is a front wall. Tank 11 has top or top panel 36 and bottom or bottom panel 37. Top panel 36 has manway 22. Wall 12 has vertical centerline 57 (see FIG. 1). Alcove 40 is offset to one side of centerline 57 as indicated by offset dimension line 58 in FIG. 1. Tank 11 has an inlet or fill port 24, a flow outlet or effluent 16, and manway 22. Cover 23 can be used to seal manway 22. Clamp ring 31 can be used to secure cover 23 to manway 22. A plurality of legs 17, 18, 19, 20 are provided. Legs 17, 18, 19, 20 can be for example about 6⅝ inches (17 cm) wide and 9 inches (23 cm) tall. Fill port 24 can be opened or closed using removable closure cap 25. Fill port 24 can be located for example about 20 inches (51 cm) from wall 13 and about 3¾ inches (10 cm) from wall 12.

Tank 11 has corner lifting fittings 26 that can be welded to top 36. Corner lifting fittings 26 can extend above top 36 for example about 3.5 inches (9 cm), and can be for example about 7 inches (18 cm) wide. Fittings 26 can be rigged with shackles (not shown) for attaching slings (not shown) or other rigging to tank 11. For example, a plurality of four slings can be used, each sling attached to a lifting eye (not shown) which would then be connected to a lifting device such as a crane. Each of the four slings would be attached to a different one of the corner lifting fittings 26 using a shackle or other rigging or fitting.

Tank 11 has effluent or outlet 16 which can be fitted with pipe joint 30, elbow 32, valve 33 having valve handle 34 and a cover or cap 35. Effluent or outlet 16 can be located for example about 9¾ inches (25 cm) from side wall 13. Valve 33 can be opened or closed using handle 34. Manway or entry 22 and cover 23 are spaced inwardly of fittings 26.

Alcove 40 is provided on front wall 12 and can be for example about 60 inches (152 cm) long, about 8 inches (20 cm) wide and about 7 inches (18 cm) deep. Alcove 40 is offset from vertical centerline 57 of panel 12 as seen in FIG. 1. Alcove 40 is secured to panel 12 with weld 46. Alcove 40 is secured to corner 29 with weld 47. In between welds 46 and 47 there is provided an alcove panel 38. The alcove panel 38 is welded to panel 12 at weld 46. The alcove panel 38 is welded to corner 29 at weld 47. Alcove panel 38 has a rear wall 41, side walls 42, 43, and bends at 48, 49. Side wall 43 can be located for example about 6½ inches (17 cm) from wall 15. Alcove 40 has top wall 44, and bottom wall 45. The alcove panel 38 rear wall 41 including side walls 42, 43 can be formed from a single piece of metal that extends to bends 48, 49. Vertical welds 46, 47 attach alcove panel 38 to tank wall 12 at a position that is spaced from corner 29.

Alcove 40 has a recess 56 that is occupied by sightglass 50. Recess 56 can be partially covered with screen 51. Screen 51 can be for example about 50 inches (127 cm) long.

Figure 2:
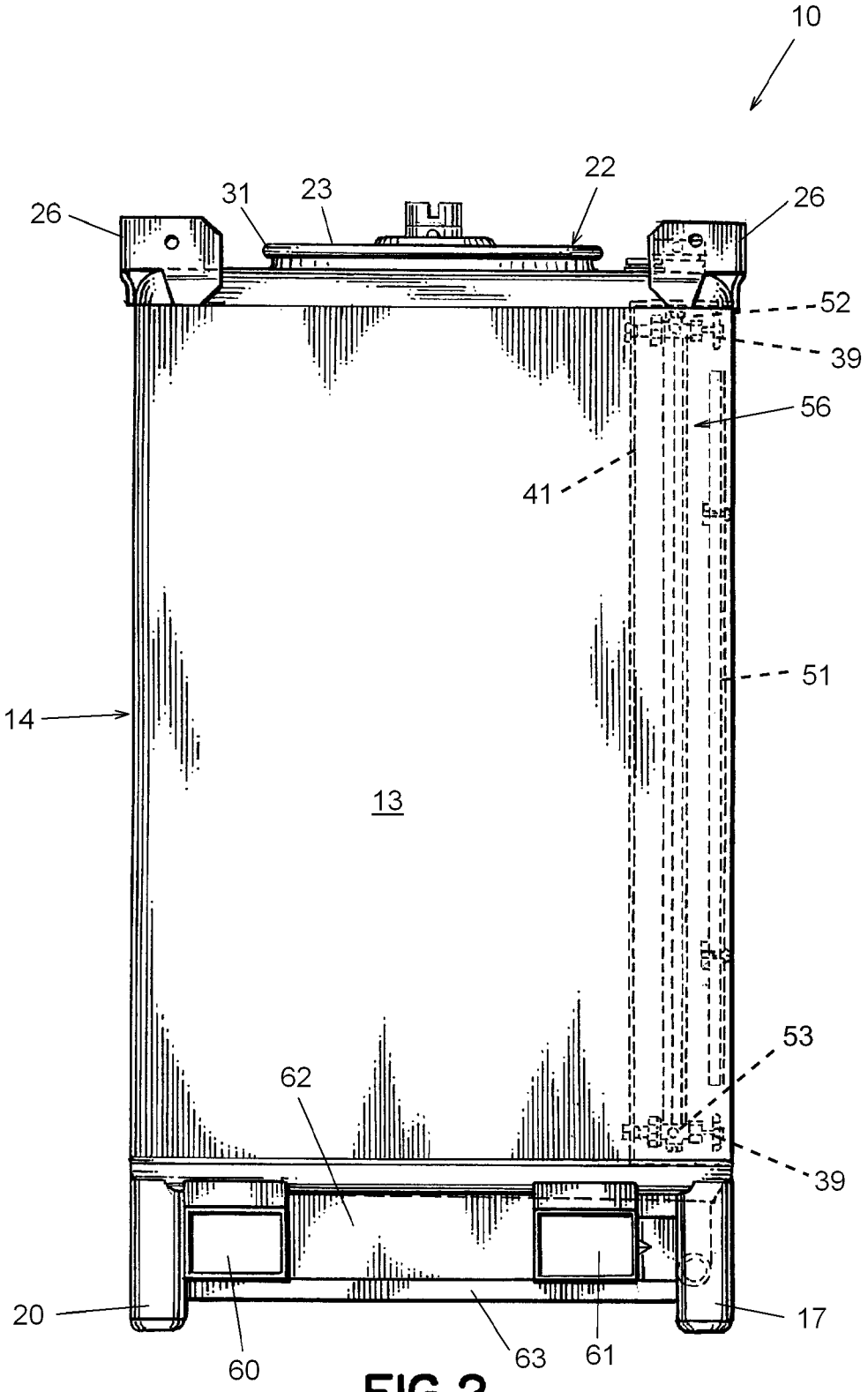
FIG. 2 is a side view of a preferred embodiment of the apparatus of the present invention, taken along lines 2-2 of FIG. 1.
Figure 3:
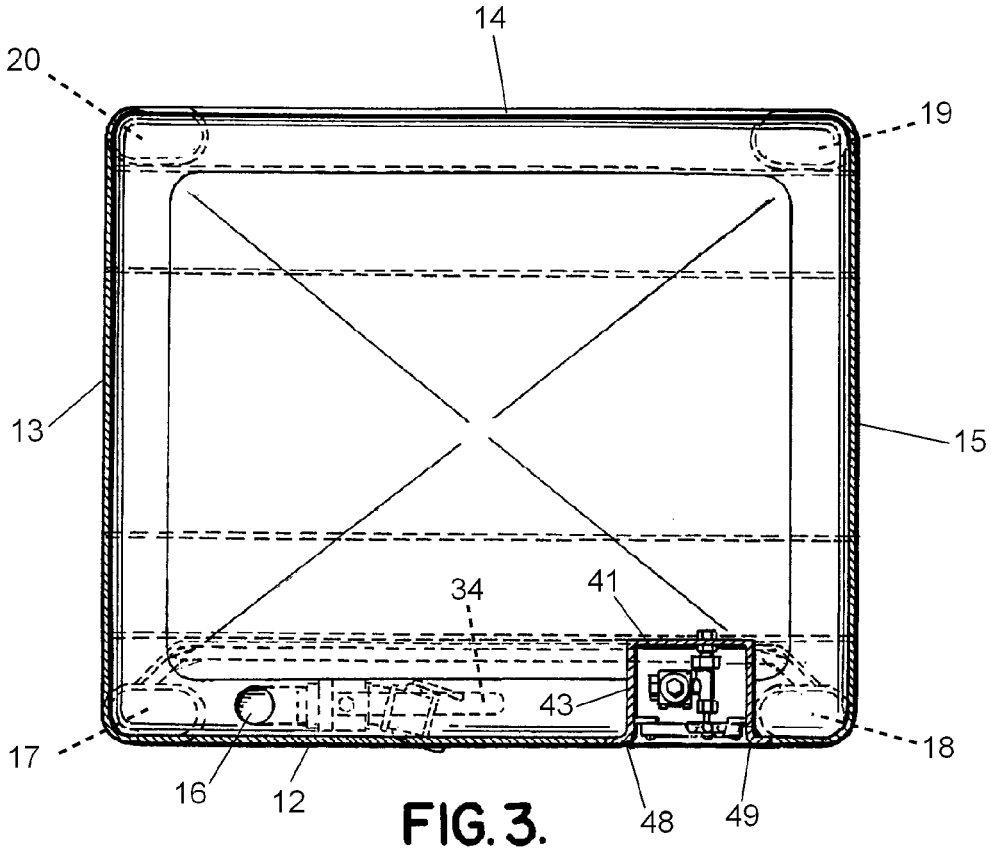
FIG. 3 is a sectional view of a preferred embodiment of the apparatus of the present invention, taken along lines 3-3 of FIG. 1.
Figure 4:
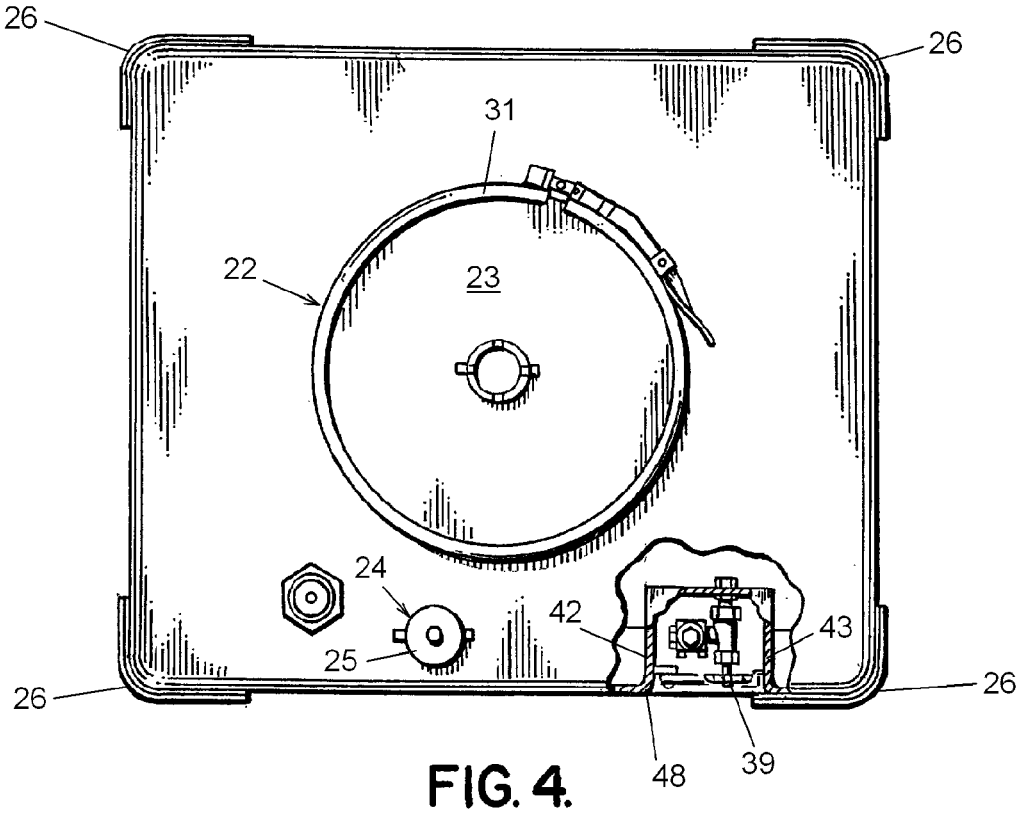
FIG. 4 is a top view of a preferred embodiment of the apparatus of the present invention, taken along lines 4-4 of FIG. 1.

Sightglass 50 has upper valve 52 and lower valve 53. Valve 52 can be located below top wall 36 for example about 2 inches (5 cm). Valve 53 can be located above bottom wall 37 for example about 2 inches (5 cm). Valves 52, 53 can be located a distance away from each other, for example about 56 inches (142 cm). Each valve 52, 53 has a valve handle 39 that enables a user to open or close a valve 52 or 53. Screen 51 has an upper end portion that is below sightglass upper valve 52 (see FIG. 1). Similarly, screen 51 extends downwardly but terminates before reaching lower valve 53 as shown in FIGS. 1-2. In this fashion, a user can access recess 56 and sightglass upper valve 52 handle 39 above screen 51. Similarly, a user can access lower valve 53 below screen 51. Alcove top wall 44 connects to top 36 at upper weld 54. Alcove bottom wall 45 connects to tank bottom 37 at lower weld 55. Upper weld 54 also joins top 36 to walls 12-15. Lower weld 55 joins tank bottom 37 to walls 12-15. Alcove top wall 44 is welded to alcove panel 38. Alcove bottom wall 45 is welded to alcove panel 38.

A pair of spaced apart fork lift channels 60, 61 are provided. Plate 62 extends between the channels 60, 61, connecting to bottom 37 and lower beam 63.

The following is a list of parts and materials suitable for use in the present invention:

PARTS LIST

| PART NUMBER | DESCRIPTION |
|---|---|
| 10 | tank rack apparatus |
| 11 | Tank/vessel |
| 12 | front wall |
| 13 | side wall |
| 14 | side wall |
| 15 | side wall |
| 16 | outlet/effluent |
| 17 | tank leg |
| 18 | tank leg |
| 19 | tank leg |
| 20 | tank leg |
| 22 | entry/manway |
| 23 | cover |
| 24 | inlet/fill port |
| 25 | closure cap |
| 26 | corner lifting fitting |
| 29 | corner |
| 30 | pipe joint |
| 31 | clamp ring |
| 32 | elbow |
| 33 | valve |
| 34 | valve handle |
| 35 | cover/cap |
| 36 | top |
| 37 | bottom |
| 38 | alcove panel |
| 39 | valve handle |
| 40 | alcove |
| 41 | alcove rear wall |
| 42 | alcove side wall |
| 43 | alcove side wall |
| 44 | alcove top wall |
| 45 | alcove bottom wall |
| 46 | vertical weld |
| 47 | vertical weld |
| 48 | bend |
| 49 | bend |
| 50 | sightglass |
| 51 | screen |
| 52 | upper valve |
| 53 | lower valve |
| 54 | upper weld |
| 55 | lower weld |
| 56 | recess |

-continued

| PART NUMBER | DESCRIPTION |
|---|---|
| 57 | centerline of panel |
| 58 | offset distance/dimension line |
| 60 | fork lift channel |
| 61 | fork lift channel |
| 62 | plate |
| 63 | beam |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A liquid storage tank comprising:

a) a tank vessel having a top wall, bottom wall, a plurality of tank side walls that each define a side wall plane, and curved tank corners at the interface of each pair of adjacent side walls, each tank side wall defining a wall plane;

b) one or more upper welds that join the tank top wall to the tank side walls;

c) one or more lower welds that join the bottom wall to the side walls;

d) one of the tank side walls having multiple panels including a larger panel and an alcove panel that includes multiple alcove side sections, an alcove rear section, and multiple alcove bends;

e) the alcove providing a recess that is in between the larger panel and a said tank curved corner, said recess extending a majority of the distance between said top wall and said bottom wall, the recess being in between the alcove side sections and in front of the alcove rear;

f) a first vertical weld that connects the alcove panel to a said curved corner and that extends to a said upper weld;

g) a second vertical weld that connects the alcove panel to a said tank side wall larger panel;

h) said recess extending inwardly of a said tank side wall plane;

i) said alcove panel including an alcove top panel next to the top wall, and an alcove bottom panel spaced above the bottom wall;

j) wherein the alcove top panel connects to the tank top at said upper weld;

k) a sight glass gage contained within said recess below the alcove top panel, above the alcove bottom panel, inwardly of a said tank side wall plane, said gage extending a majority of the distance between the alcove top panel and the alcove bottom panel;

l) wherein the sight glass includes a vertically extending portion that is spaced in front of said alcove rear section and in between said alcove side sections and extending a majority of the distance between the alcove top panel and the alcove bottom panel; and m) upper and lower fittings supporting the vertically extending portion, each fitting mounted to the alcove panel at vertically space apart positions.

2. The liquid storage tank of claim 1 further comprising a screen that occupies a said side wall plane, the screen positioned in front of the sight glass vertically extending portion and extending between a position next to the alcove top panel and a position next to the alcove bottom panel.

3. The liquid storage tank of claim 1 wherein the fittings are valves.

4. The liquid storage tank of claim 1 wherein the alcove panel has four bends.

5. The liquid storage tank of claim 1 wherein the recess is spaced below the top wall.

6. The liquid storage tank of claim 1 wherein the recess is spaced above the bottom wall.

7. The liquid storage tank of claim 3 wherein a said valve is next to and below an upper welded connection that joins the top wall to a side wall.

8. The liquid storage tank of claim 3 wherein a said valve is next to and above a lower welded connection that joins the bottom wall to a side wall.

9. The liquid storage tank of claim 1 further comprising lifting eyes that attach to the tank above the recess.

10. The liquid storage tank of claim 3 further comprising a screen that at least partially covers the vertical portion of the sight glass.

11. The liquid storage tank of claim 10 wherein one of the valves is an upper valve and the screen is spaced below said upper valve.

12. The liquid storage tank of claim 11 wherein the upper valve is below an upper welded connection that joins the top wall to a side wall.

13. The liquid storage tank of claim 10 wherein one of the valves is a lower valve above a lower welded connection that joins the bottom wall to a side wall.

14. A liquid storage tank comprising:

a) a tank vessel having a top wall, bottom wall, a plurality of side walls each having a side wall plane, and curved tank corners at the interface of each pair of adjacent side walls, each side wall defining a wall plane;

b) one of the tank side walls having a vertical centerline, multiple panels including a first larger panel and an alcove panel that is smaller than the first panel and that includes multiple bends;

c) the alcove panel being a part of a tank alcove that is in between the larger panel and a said curved tank corner, said alcove panel being offset laterally from the vertical centerline and connected to a said curved tank corner with a vertical weld;

d) said alcove extending inwardly of a said tank side wall plane;

e) said alcove having an alcove top, an alcove bottom, an alcove rear wall and opposed alcove side walls;

f) a sight glass gage contained in said alcove, below the alcove top, above the alcove bottom and inwardly of said tank wall plane, said gage extending a majority of the distance between the alcove top and the alcove bottom, said sight glass including a vertical portion that extends a majority of the distance between the tank top and bottom walls;

g) upper and lower valves supporting the vertically extending portion, each valve mounted to the alcove panel; and h) wherein the tank top is welded to the tank side walls at an upper weld that extends to the said vertical weld, and wherein the alcove top attaches to the tank top wall at said upper weld.

15. The liquid storage tank of claim 14 further comprising a screen that occupies a said wall plane, the screen extending between a position next to the alcove top and a position next to the alcove bottom.

16. The liquid storage tank of claim 14 wherein the second panel has four bends.

17. The liquid storage tank of claim 14 wherein the alcove is spaced below the top wall.

18. The liquid storage tank of claim 14 wherein the alcove is spaced above the bottom wall.

* * * * *